US010077688B2

(12) United States Patent
Chung et al.

(10) Patent No.: US 10,077,688 B2
(45) Date of Patent: Sep. 18, 2018

(54) CAM SHAFT PHASER WITH MID-POSITION AND RETARD LOCK POSITION

(71) Applicant: Schaeffler Technologies AG & Co. KG, Herzogenaurach (DE)

(72) Inventors: Inhwa Chung, Lasalle (CA); Gerhard Scheidig, Oberasbach (DE); Steven Burke, Fort Gratiot, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 110 days.

(21) Appl. No.: 15/048,323

(22) Filed: Feb. 19, 2016

(65) Prior Publication Data

US 2016/0245131 A1 Aug. 25, 2016

Related U.S. Application Data

(60) Provisional application No. 62/120,555, filed on Feb. 25, 2015.

(51) Int. Cl.
*F01L 1/34* (2006.01)
*F01L 1/344* (2006.01)

(52) U.S. Cl.
CPC ... *F01L 1/3442* (2013.01); *F01L 2001/34423* (2013.01); *F01L 2001/34426* (2013.01); *F01L 2001/34433* (2013.01); *F01L 2001/34459* (2013.01); *F01L 2001/34463* (2013.01); *F01L 2001/34469* (2013.01); *F01L 2250/02* (2013.01)

(58) Field of Classification Search
CPC ..... F01L 1/3442; F01L 2013/111; F01L 2001/34423; F01L 2001/34459; F01L 2001/34463; F01L 2001/34469
USPC ..... 123/90.15, 90.17
See application file for complete search history.

(56) References Cited

U.S. PATENT DOCUMENTS

| | | | | |
|---|---|---|---|---|
| 7,290,510 | B2 * | 11/2007 | Takahashi | F01L 1/022 123/90.12 |
| 2007/0107684 | A1 | 5/2007 | Takahashi et al. | |
| 2013/0000576 | A1 | 1/2013 | Tanaka et al. | |
| 2014/0290606 | A1 | 10/2014 | Kanai | |

FOREIGN PATENT DOCUMENTS

| | | |
|---|---|---|
| JP | 2013189910 | 9/2013 |
| JP | 2014240639 | 12/2014 |
| WO | 2014/146626 | 9/2014 |

* cited by examiner

*Primary Examiner* — Ching Chang

(57) ABSTRACT

A cam shaft phaser, including: a stator including stops; a rotor rotatable with respect to the stator and including a plurality vanes extending radially outward from a body; a plurality of channels, each channel passing through a respective vane included in the plurality of vanes; and a plurality of pairs of advance and retard chambers at least partially formed by the plurality of radially inwardly extending stops and the plurality of vanes. Advance and retard chambers for each pair of advance and retard chambers are separated in a first circumferential direction by a respective vane from the plurality of vanes. Each channel connects the advance and retard chambers for said each pair of advance and retard chambers. The first plurality of channels are arranged to enable fluid flow through the first plurality of channels to displace the rotor from at least one circumferential position to a mid-lock or retard-lock position.

20 Claims, 17 Drawing Sheets

CAM SHAFT PHASER WITH MID-POSITION AND RETARD LOCK POSITION

CROSS-REFERENCE TO RELATED APPLICATIONS

This application claims the benefit under 35 U.S.C. § 119(e) of U.S. Provisional Patent Application No. 62/120,555, filed Feb. 25, 2015, which application is incorporated herein by reference in its entirety.

TECHNICAL FIELD

The invention relates generally to a cam shaft phaser configured to adjust and lock a circumferential position of a rotor. In particular, the cam shaft phaser controls pressurized fluid flow between chambers in the rotor and uses cam shaft torsionals to displace the rotor to a mid-lock position or a retard-lock position and locks the rotor in the mid-lock position or retard-lock position.

BACKGROUND

Pressurized fluid is supplied to advance and return chambers in a cam shaft phaser for an engine in a vehicle to control a circumferential position of a rotor for the phaser with respect to a stator for the phaser. As is known in the art, the position of the rotor is varied according to the requirements of the engine. In some instances, it is desirable for the rotor to be in a mid-position when an engine including the cam shaft phaser is started up. In some instances, it is desirable for the rotor to be in a fully retarded position when an engine including the cam shaft phaser is started up. However, the rotor can come to rest such that at start-up of the engine, the rotor is at neither the mid-position nor the fully retarded position.

SUMMARY

According to aspects illustrated herein, there is provided a cam shaft phaser, including: a stator including a plurality of radially inwardly extending stops; a rotor rotatable with respect to the stator and including a body with an opening through which an axis of rotation for the cam shaft phaser passes and a plurality vanes extending radially outward from the body; a first plurality of channels, each channel in the first plurality of channels passing through a respective vane included in the plurality of vanes; and a plurality of pairs of advance and retard chambers at least partially formed by the plurality of radially inwardly extending stops and the plurality of vanes. Advance and retard chambers for each pair of advance and retard chambers are separated in a first circumferential direction by a respective vane from the plurality of vanes. Each channel connects the advance and retard chambers for said each pair of advance and retard chambers. The first plurality of channels are arranged to enable fluid flow through the first plurality of channels to displace the rotor from at least one circumferential position to a mid-lock or retard-lock position.

According to aspects illustrated herein, there is provided a cam shaft phaser, including: a stator including a plurality of radially inwardly extending stops; a rotor rotatable with respect to the stator and including a body with an opening through which an axis of rotation for the cam shaft phaser passes and a plurality vanes extending radially outward from the body; a first plurality of channels, each channel in the first plurality of channels passing through a respective vane included in the plurality of vanes; a first plurality of pins; and a plurality of pairs of advance and retard chambers at least partially formed by the plurality of radially inwardly extending stops and the plurality of vanes. Each vane includes a respective pin from the first plurality of pins partially disposed in the respective channel from the first plurality of channels. The first plurality of pins is displaceable to open the first plurality of channels to displace the rotor from the at least one first circumferential position to a retard-lock position; advance and retard chambers for each pair of advance and retard chambers are separated in a first circumferential direction by a respective vane from the plurality of vanes; Each channel connects the advance and retard chambers for said each pair of advance and retard chambers. The first plurality of channels are arranged to be opened to enable fluid flow through the first plurality of channels to displace the rotor from at least one circumferential position to a retard-lock position. In the retard-lock position, the rotor is rotated to a full extent possible in a direction from respective advance chambers to the respective retard chambers in the plurality of pairs of advance and retard chambers.

According to aspects illustrated herein, there is provided a method of operating a cam shaft phaser including a stator with a plurality of radially inwardly extending stops, a rotor rotatable with respect to the stator and with a body with an opening through which an axis of rotation for the cam shaft phaser passes and a plurality vanes extending radially outward from the body, a first plurality of channels with each channel in the first plurality of channels passing through a respective vane included in the plurality of vanes, a plurality of pairs of advance and retard chambers at least partially formed by the plurality of radially inwardly extending stops and the plurality of vanes, a first pin, and a front cover with a first slot, the method including: displacing a first plurality of pins, at least partially disposed in the first plurality of channels to connect, with the first plurality of channels, the advance chamber in each pair of advance and retard chambers with the retard chamber in said each pair of advance and retard chambers; flowing pressurized fluid through the first plurality of channels and between the advance chamber in each pair of advance and retard chambers and the retard chamber in said each pair of advance and retard chambers; rotating, with the pressurized fluid, the rotor in a first circumferential direction to a retard-lock position in which the rotor is rotated to a full extent possible in the first circumferential direction; and displacing the first pin into the first slot to rotationally fix the rotor in the retard-lock position.

BRIEF DESCRIPTION OF THE DRAWINGS

The nature and position of operation of the present invention will now be more fully described in the following detailed description of the invention taken with the accompanying figures, in which.

DETAILED DESCRIPTION

At the outset, it should be appreciated that like drawing numbers on different drawing views identify identical, or functionally similar, structural elements of the invention. While the present invention is described with respect to what is presently considered to be the preferred aspects, it is to be understood that the invention as claimed is not limited to the disclosed aspect. The present invention is intended to include various modifications and equivalent arrangements within the spirit and scope of the appended claims.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the preferred methods, devices, and materials are now described.

Figure 1:
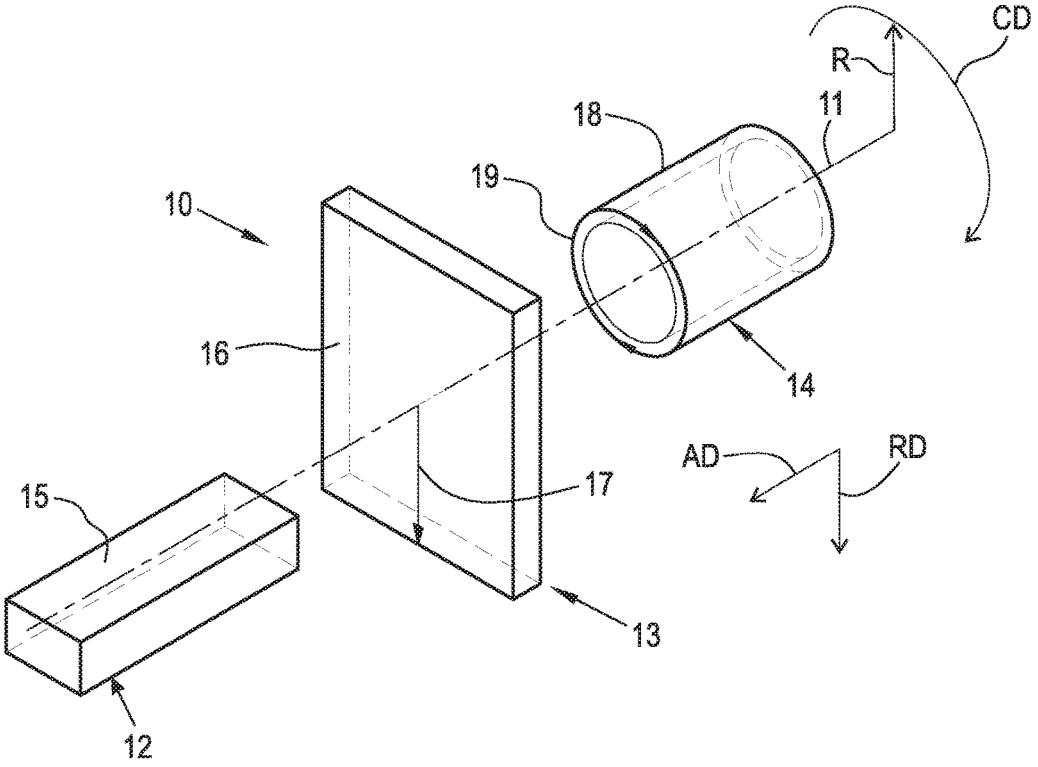
FIG. 1 is a perspective view of a cylindrical coordinate system demonstrating spatial terminology used in the present application.

FIG. 1 is a perspective view of cylindrical coordinate system 10 demonstrating spatial terminology used in the present application. The present application is at least partially described within the context of a cylindrical coordinate system. System 10 includes longitudinal axis 11, used as the reference for the directional and spatial terms that follow. Axial direction AD is parallel to axis 11. Radial direction RD is orthogonal to axis 11. Circumferential direction CD is defined by an endpoint of radius R (orthogonal to axis 11) rotated about axis 11.

To clarify the spatial terminology, objects 12, 13, and 14 are used. An axial surface, such as surface 15 of object 12, is formed by a plane co-planar with axis 11. Axis 11 passes through planar surface 15; however any planar surface co-planar with axis 11 is an axial surface. A radial surface, such as surface 16 of object 13, is formed by a plane orthogonal to axis 11 and co-planar with a radius, for example, radius 17. Radius 17 passes through planar surface 16; however any planar surface co-planar with radius 17 is a radial surface. Surface 18 of object 14 forms a circumferential, or cylindrical, surface. For example, circumference 19 is passes through surface 18. As a further example, axial movement is parallel to axis 11, radial movement is orthogonal to axis 11, and circumferential movement is parallel to circumference 19. Rotational movement is with respect to axis 11. The adverbs "axially," "radially," and "circumferentially" refer to orientations parallel to axis 11, radius 17, and circumference 19, respectively. For example, an axially disposed surface or edge extends in direction AD, a radially disposed surface or edge extends in direction R, and a circumferentially disposed surface or edge extends in direction CD.

Figure 2:
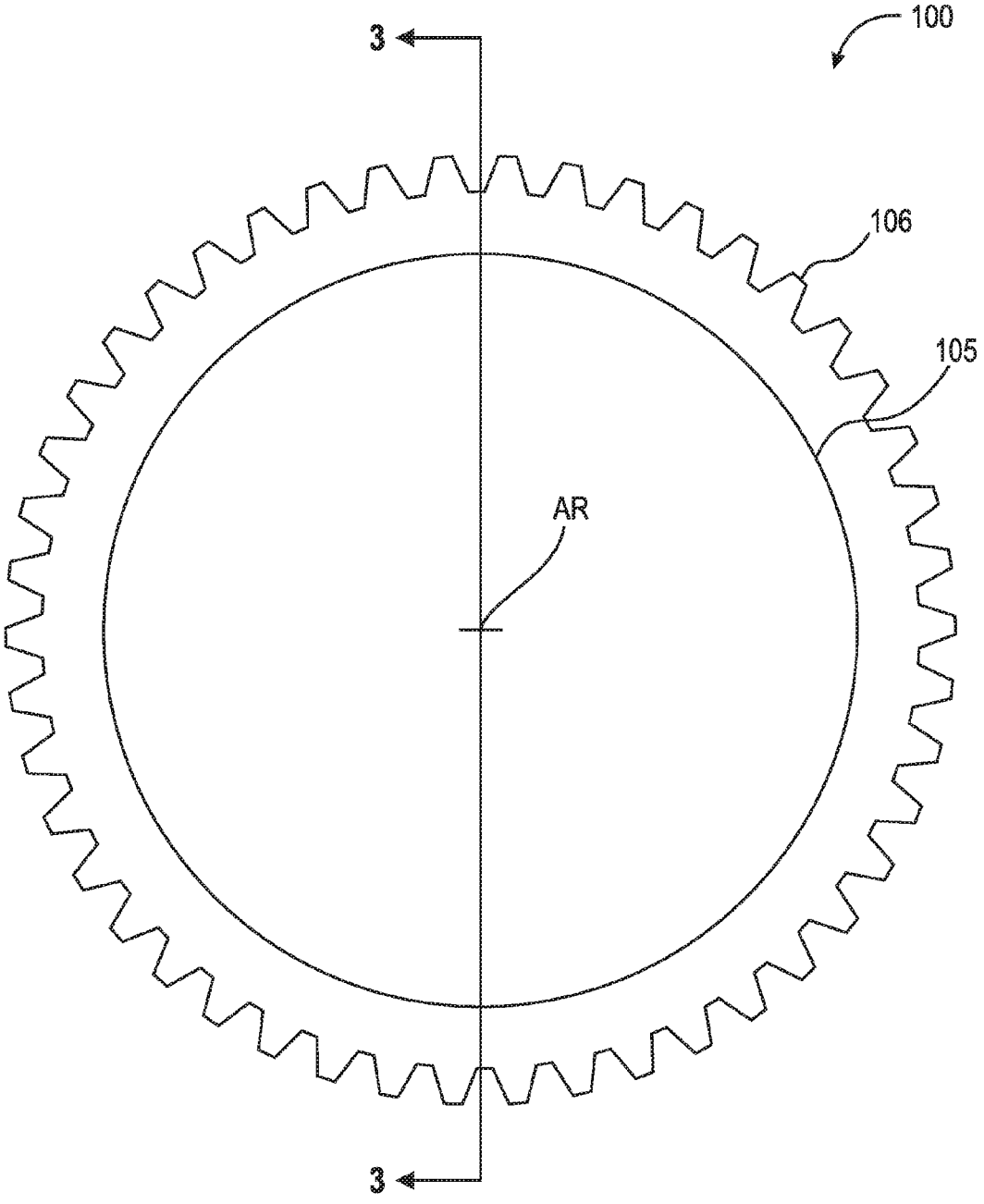
FIG. 2 is a rear view of a cam shaft assembly including a cam shaft phaser with mid-lock and retard-lock adjustment.

FIG. 2 is a rear view of a cam shaft assembly including cam shaft phaser 100 with mid-lock and retard-lock adjustment.

Figure 3:
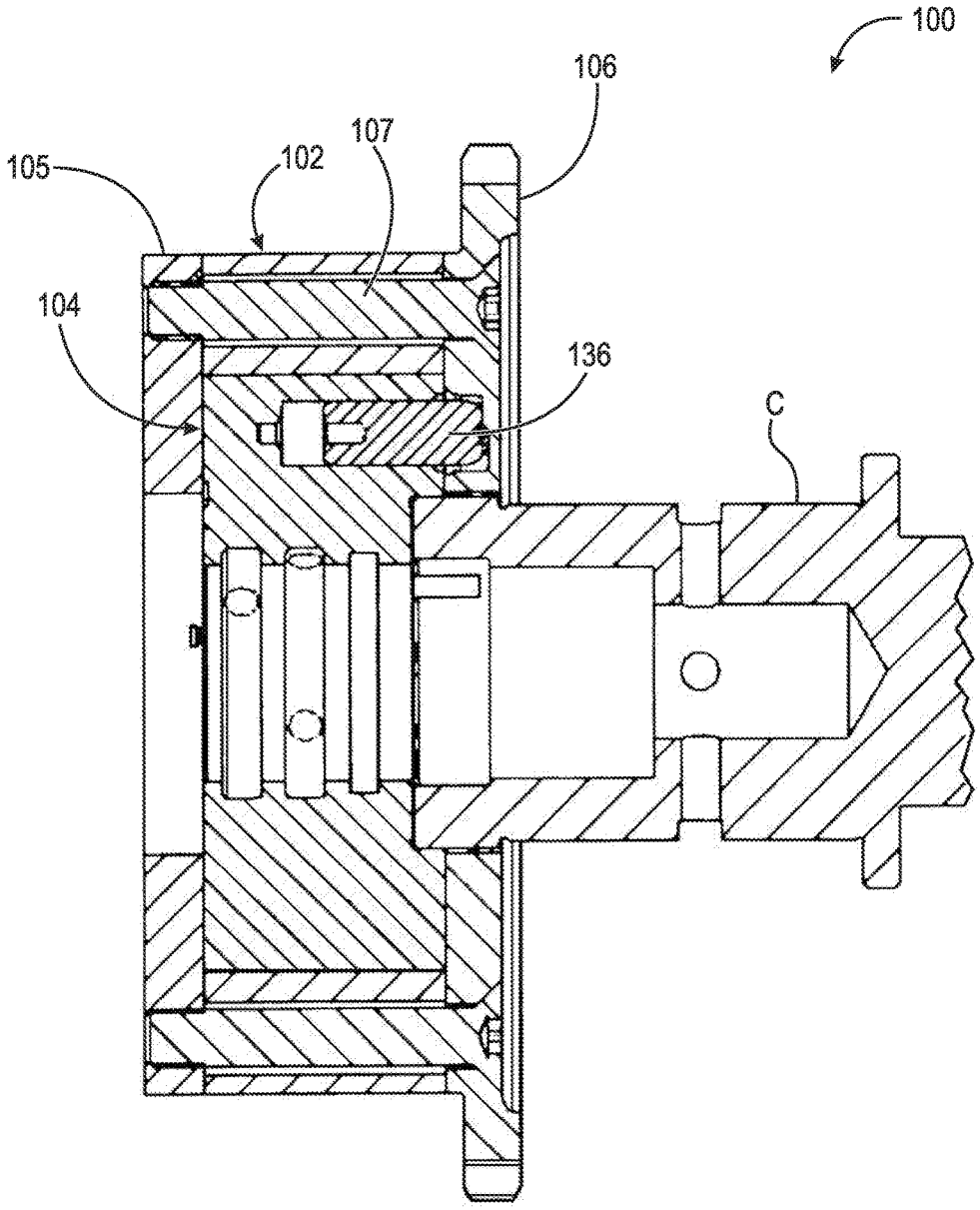
FIG. 3 is a cross-sectional view generally along line 3-3 in FIG. 2.

FIG. 3 is a cross-sectional view generally along line 3-3 in FIG. 2.

Figure 4:
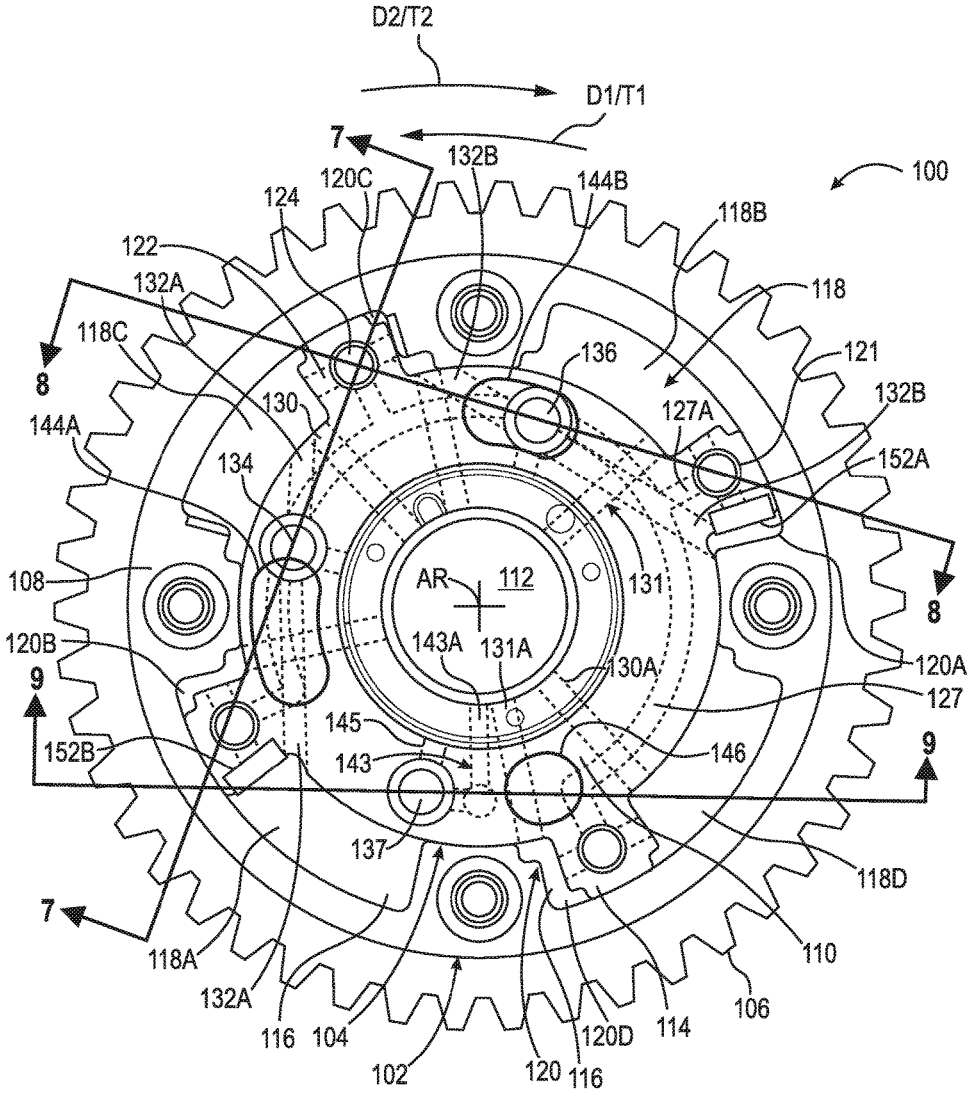
FIG. 4 is a front view of the cam shaft phaser in FIG. 2 with the rear cover removed and the rotor in an advanced position.

FIG. 4 is a front view of cam shaft phaser 100 in FIG. 2 with the rear cover removed and the rotor in an advanced position.

Figure 5:
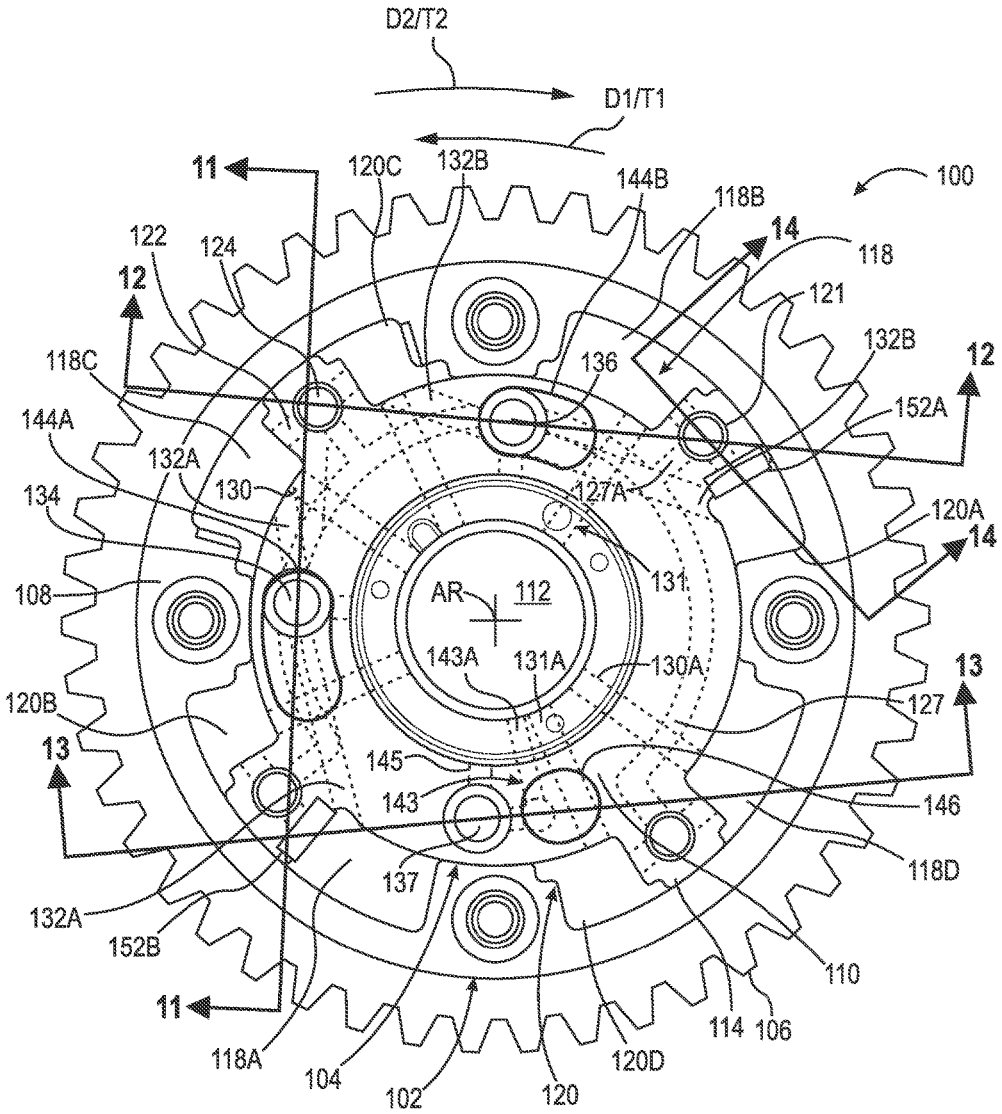
FIG. 5 is a front view of the cam shaft phaser in FIG. 2 with the rear cover removed and the rotor in a mid-lock position.

FIG. 5 is a front view of cam shaft phaser 100 in FIG. 2 with the rear cover removed and the rotor in a mid-lock position.

Figure 6:
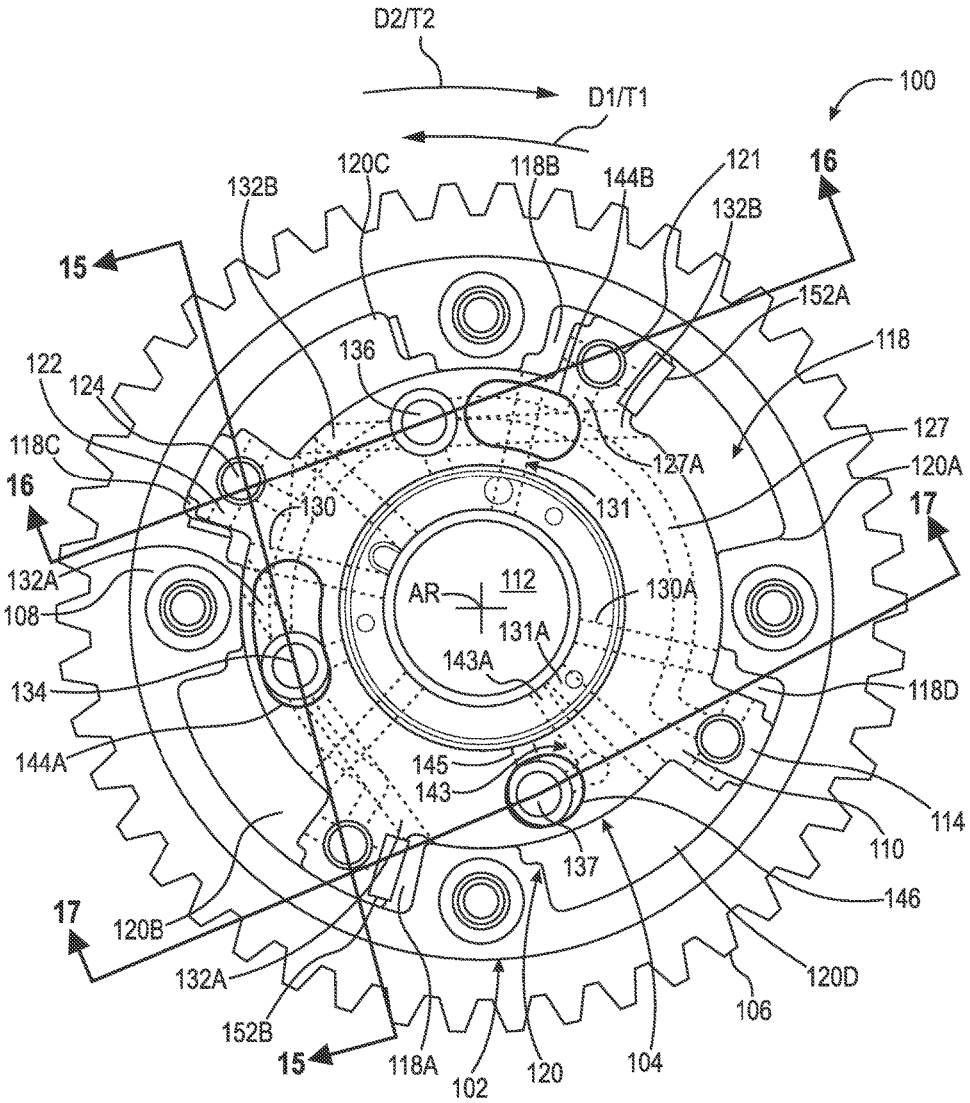
FIG. 6 is a front view of the cam shaft phaser in FIG. 4 with the rear cover removed and the rotor in a retard-lock position.

FIG. 6 is a front view of cam shaft phaser 100 in FIG. 4 with the rear cover removed and the rotor in a retard-lock position. The following should be viewed in light of FIGS. 2 through 6. Cam shaft phaser 100 includes stator 102 and rotor 104 rotatable with respect to stator 102. Phaser 100 also includes front cover 105, rear cover 106, and bolts 107 fixing stator 102, cover 105 and cover 106 together. Stator 102 includes radially inwardly extending stops 108. Rotor 104 includes body 110 with opening 112 through which axis of rotation AR for cam shaft phaser 100 passes, and vanes 114 extending radially outward from the body. Cam shaft phaser 100 includes pairs 116 of advance chambers 118 and retard chambers 120. Chambers 118 and 120 are at least partially formed by stator 102 and rotor 104, in particular by stops 108 and vanes 114.

In an example embodiment, rotor 104 includes slots 126 and channels 122 in vanes 114. Each channel 122 connects the advance and retard chambers separated by the vane 114 in which the channel 122 is located. Each channel 122 is wholly surrounded by the vane 114 in which the channel is located and is open only to a slot 126 and the advance and retard chambers separated by the vane 114 in which the channel 122 is located. In an example embodiment, each vane 114 includes a pin 124 partially disposed in a respective channel 122 and a respective slot 126. Each slot 126 is connected to a source of pressurized fluid by a respective portion 127A of channel 127.

Rotor 104 can come to rest or be actively operating in an advanced position (as shown in FIG. 4), a mid, or mid-lock position (as shown in FIG. 5) or a retarded, or retard-lock position (as shown in FIG. 6). In FIG. 5, the respective volumes of chambers 118 and 120 are equal or are different by a relatively nominal degree. Stated otherwise, vanes 114 are approximately half-way between circumferentially adjacent stops. In some circumstances, it is desirable to adjust the rotor to and lock the rotor in the mid-lock or retard-lock position. To displace rotor 104 to the desired locked positions of FIG. 5 or 6, pins 124 are arranged to be displaced to open channels 122 as described below to enable flow between chambers 118 and 120.

In an example embodiment, rotor 104 includes channels 130, 131, 132A, and 132B. Chambers 118B-D are connected to opening 112 with a respective channel 130. Retard chambers 120B-D are connected to opening 112 with a respective channel 131. Channels 130 and 131 are used to supply pressurized fluid to and drain fluid from chambers 118 and 120, respectively. Chambers 118A and 120A are not directly supplied with pressurized fluid by channels 130 and 131, respectively. Instead: channel 132A connects chamber 118C to chamber 118A and is to supply pressurized fluid to and drain fluid from chamber 118C to chamber 118A; and channel 132B connects chamber 120C to chamber 120A and is used to supply pressurized fluid to and drain fluid from chamber 120C to chamber 120A.

Cam shaft phaser 100 includes pins 134, 136 and 137. Pins 134 and 136 are partially disposed in channels 132A and 132B, respectively. Pins 134 and 136 are disposed in slots 138A and 138B, respectively in body 110. Pin 137 is disposed in slot 139 and is connected to a system for supplying pressurized fluid for the phaser (hereinafter referred to as "the fluid system") by channels 141, 143 and 145. The fluid system supplies fluid to and drains fluid from rotor 104 via openings 130A and 131A at opening 112 for channels 130 and 131, respectively. The fluid system supplies fluid to and drains fluid from slot 139 by opening 143A at opening 112.

Figure 7:
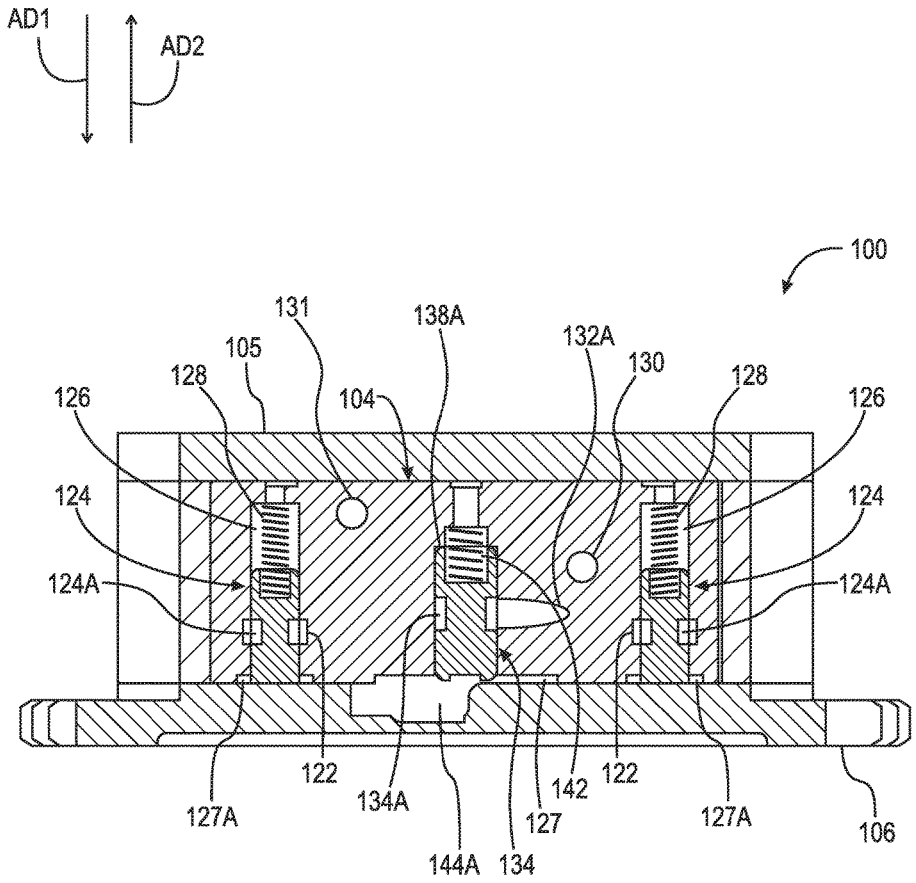
FIG. 7 is a cross-sectional views generally along line 7-7 in FIG. 4.

FIG. 7 is a cross-sectional views generally along line 7-7 in FIG. 4.

Figure 8:
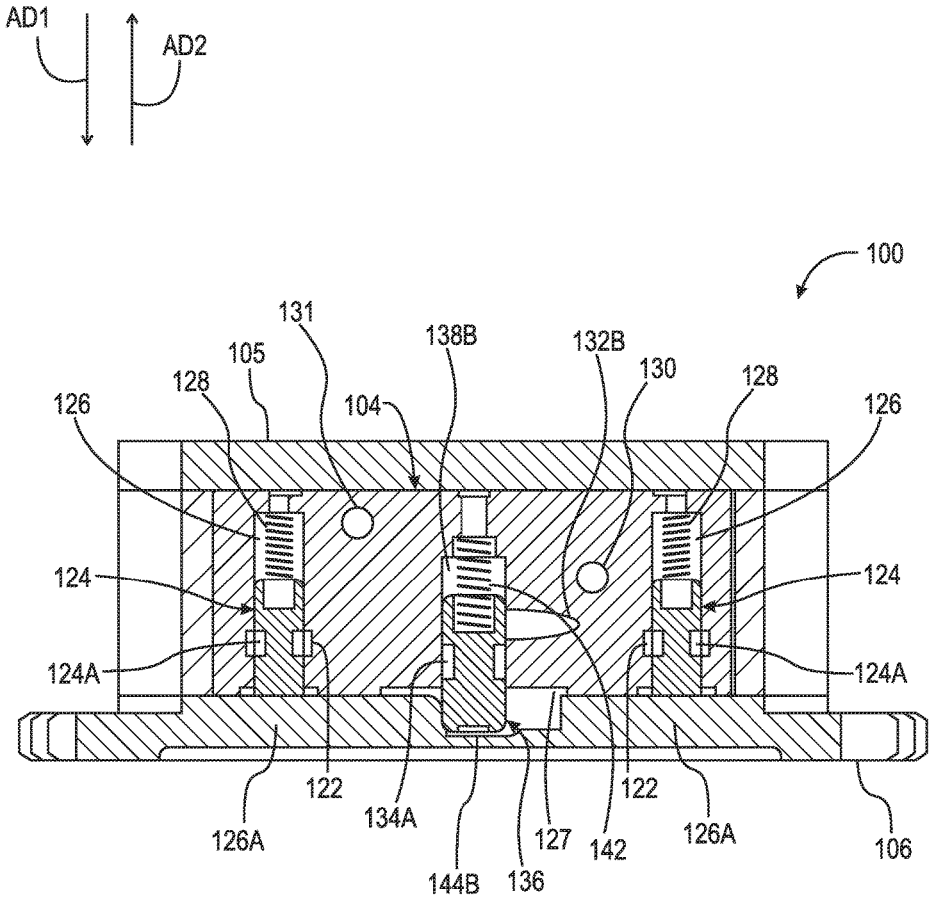
FIG. 8 is a cross-sectional views generally along line 8-8 in FIG. 4.

FIG. 8 is a cross-sectional views generally along line 8-8 in FIG. 4.

Figure 9:
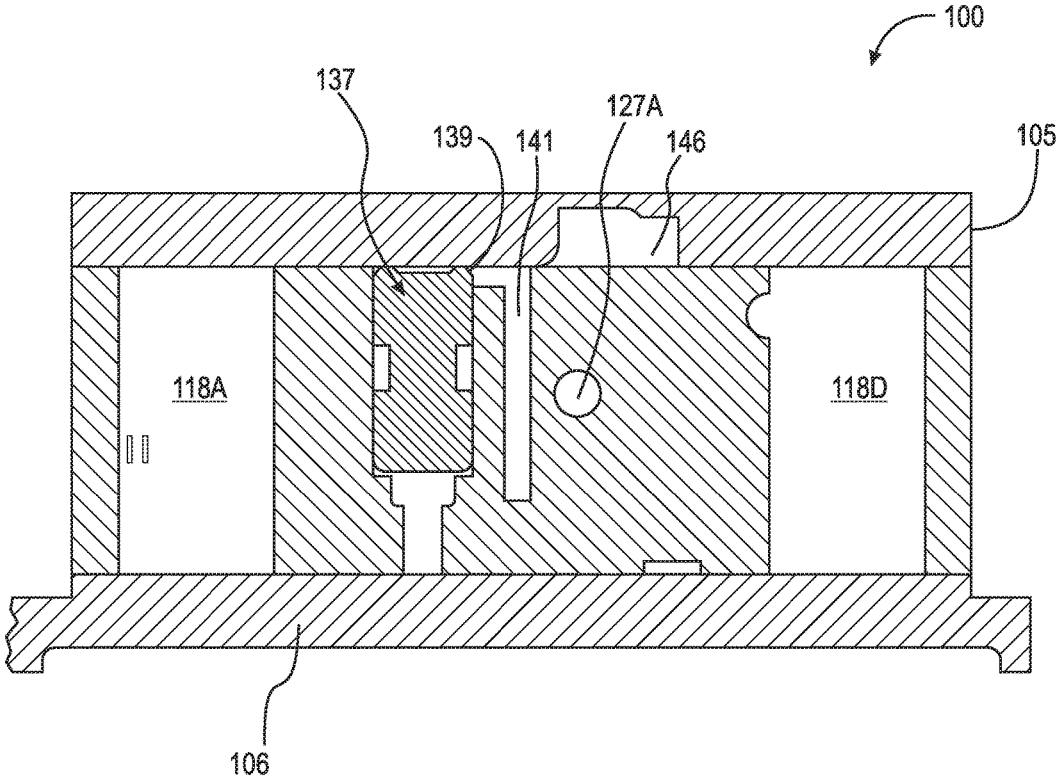
FIG. 9 is a cross-sectional views generally along line 9-9 in FIG. 4.

FIG. 9 is a cross-sectional views generally along line 9-9 in FIG. 4. The following should be viewed in light of FIGS. 2 through 9. In FIG. 4, phaser 100 is in an advanced position and it is desired to lock the rotor in the mid-lock or retard-lock position. FIGS. 7 through 9 illustrates the adjustment of the rotor in direction D2 from the position in FIG. 4 to the mid-lock position in FIG. 5 or the retard-lock position of FIG. 6.

To initiate the adjustment to the mid-lock position or retard-lock position, channels 127 and portions 127A are connected to the fluid system so that there is little or nominal fluid pressure in channels 127 and portions 127A. As a result, springs 128 displace pins 124 in direction AD1 so that slots 124A are aligned with channels 122 to enable flow through channels 122 and between chambers 118 and 120 as shown in FIG. 7. The function of channels 122 is further described below. In addition, pin 134 is in contact with cover 106, which aligns slot 134A of pin 134 with channel 132A to enable flow between chambers 118C and 118A.

As shown in FIG. 8, springs 128 displace pins 124 in direction AD1 so that slots 124A are aligned with channels 122 to enable flow through channels 122 and between chambers 118 and 120. Spring 142 pushes pin 136 in direction AD1 so that slots 136A is misaligned with channel 132B blocking flow through channel 132B. As shown in FIG. 9, pin 137 is in contact with the front cover so pin 137 does not block rotation of the rotor. The locations of slots 144A and 144B in the rear cover plate are shown as they would be positioned in FIGS. 4 through 6. The location of slot 146 in the front cover is shown as a solid line in FIGS. 4 through 6 to clarify the presentation, given the number of dashed lines in the figures.

Phaser 100 includes check valve, or one-way valves 152A and 152B. Valve 152A is located at the opening of channel 122 at chamber 120A and valve 152B is located at the opening of channel 122 at chamber 118A. Valve 152A enables fluid flow from chamber 118B to chamber 120A, but blocks flow from chamber 120A to chamber 118B. Valve 152B enables fluid flow from chamber 120B to chamber 118A, but blocks flow from chamber 118A to chamber 120B.

Figure 10:
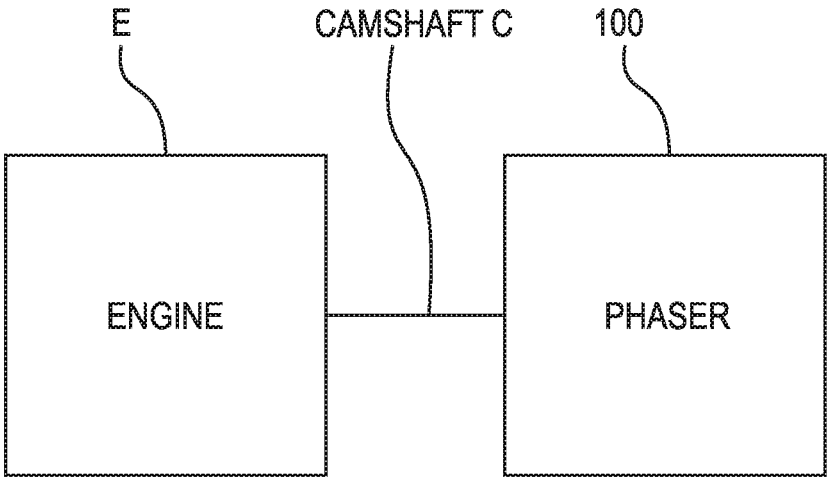
FIG. 10 is a block diagram of an engine including the cam shaft phaser in FIG. 2.

FIG. 10 is a block diagram of engine E including cam shaft phaser 100 in FIG. 2 connected to camshaft C as is known in the art. The following provides further example detail regarding operation of cam shaft phaser 100. In particular, the following describes the process of displacing the rotor from the position in FIG. 4 to the mid-lock position shown in FIG. 5 or the retard-lock position shown in FIG. 6. The following sequence can occur as engine E is being turned off, as engine E is turned on, or as engine E is running.

Pressurized fluid is applied to channels 130. As camshaft C rotates, the camshaft alternately transmits rotational torque T1 and T2 to rotor 104 in opposite directions D1 and D2, respectively. That is, the camshaft transmits alternating "pulses" of torque T1 and T2 that urge the rotor in directions D1 and D2, respectively. As further described below, each time torque T1 rotates the rotor in direction D1, fluid flows through each chamber 118 to the respective chamber 120 through the respective channel 122 to enable the rotor to rotate in direction D1 and to fill the spaces in the chambers 120 created by the rotation. Thus, in particular, chamber 120A expands in size and is filled with fluid. As torque T2 rotates in direction D2, the rotor is urged in direction D2. However, pin 136 is blocking channel 132B and one-way valve 152A prevents fluid from passing through the respective channel 122 from chamber 120A to chamber 118B. Thus, the rotor cannot rotate in direction D2 and the rotor remains in the position caused by the rotation due to torque T1.

The above process is repeated until the rotor has rotated to the position shown in FIG. 5 or 6. For example: in response to the next iteration of torque T1, the rotor rotates further in direction D1, chamber 120A expands in size, and chamber 120 is filled with fluid from chamber 118B; and in response to the next iteration of torque T2, pin 136 and valve 152A prevent fluid from draining from chamber 120A, and the fluid in chamber 120A prevents the rotor from rotating in direction D2.

The above procedure is used to rotate the rotor in direction D1 to the mid-lock position with the following changes. Pin 136 is in contact with the rear cover to open channel 132B and pin 134 is in slot 144A to block channel 132. For each iteration of torque T2, the rotor is displaced in direction D2 and chamber 118A increases in size and is filled with fluid from chamber 120B. For each iteration of torque T1, chamber 118A blocks rotation of the rotor in direction D1 since pin 134 and check valve 152B prevent fluid from draining from chamber 120B.

In FIG. 5, the sequence described above for FIGS. 4 through 9 has rotated the rotor to the mid-lock position shown in FIG. 5. Channel 127 remains unpressurized. Therefore, pin 132 remains in slot 144A in the rear cover and pins 134 is pushed into slot 144B in the rear cover by springs 142. Pin 134 blocks rotation of the rotor in direction D1 and pin 136 blocks rotation of the rotor in direction D2.

Figure 11:
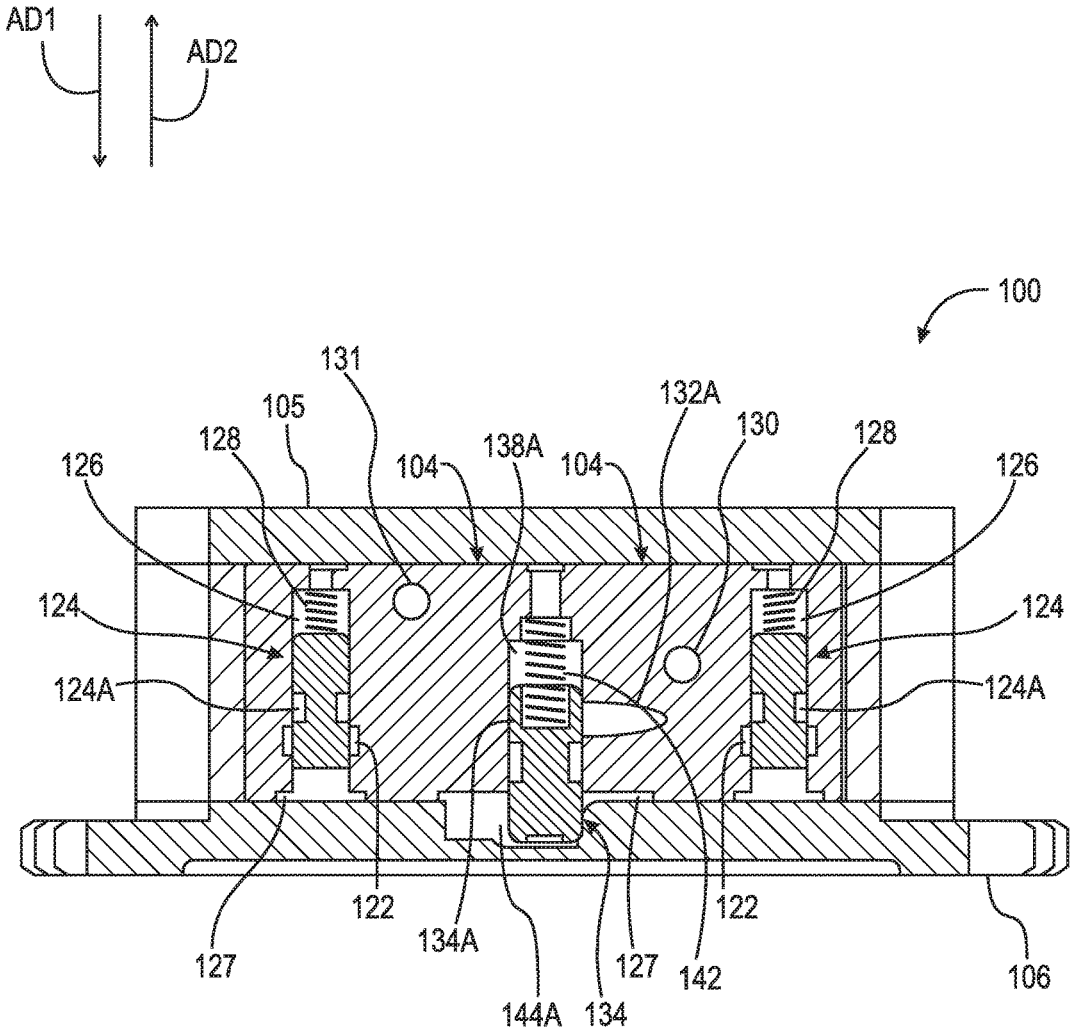
FIG. 11 is a cross-sectional views generally along line 11-11 in FIG. 5.

FIG. 11 is a cross-sectional views generally along line 11-11 in FIG. 5.

Figure 12:
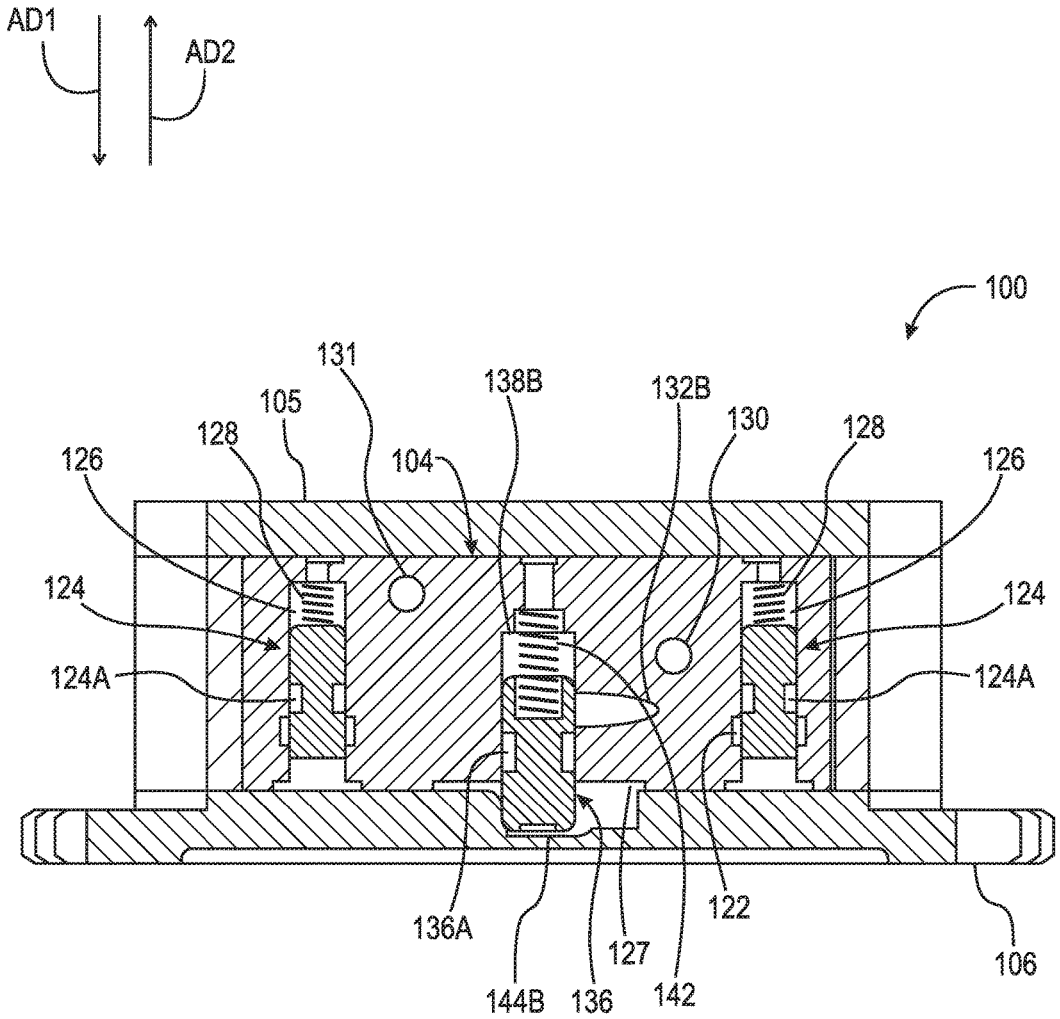
FIG. 12 is a cross-sectional views generally along line 12-12 in FIG. 5.

FIG. 12 is a cross-sectional views generally along line 12-12 in FIG. 5.

Figure 13:
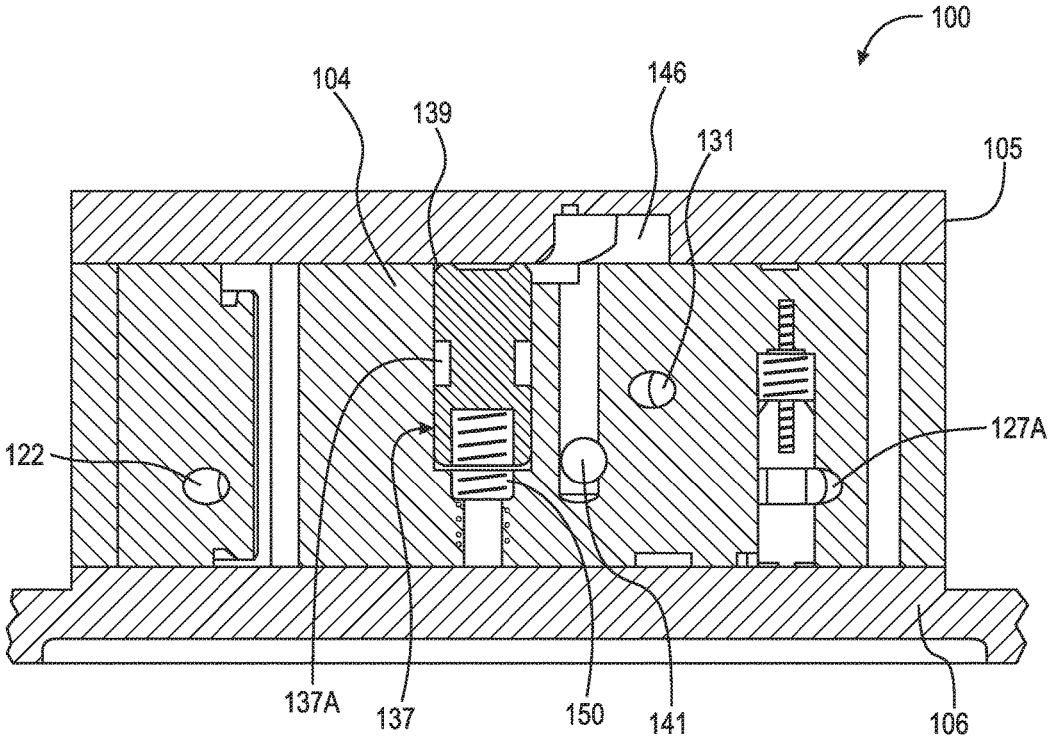
FIG. 13 is a cross-sectional views generally along line 13-13 in FIG. 5.

FIG. 13 is a cross-sectional views generally along line 13-13 in FIG. 5.

Figure 14:
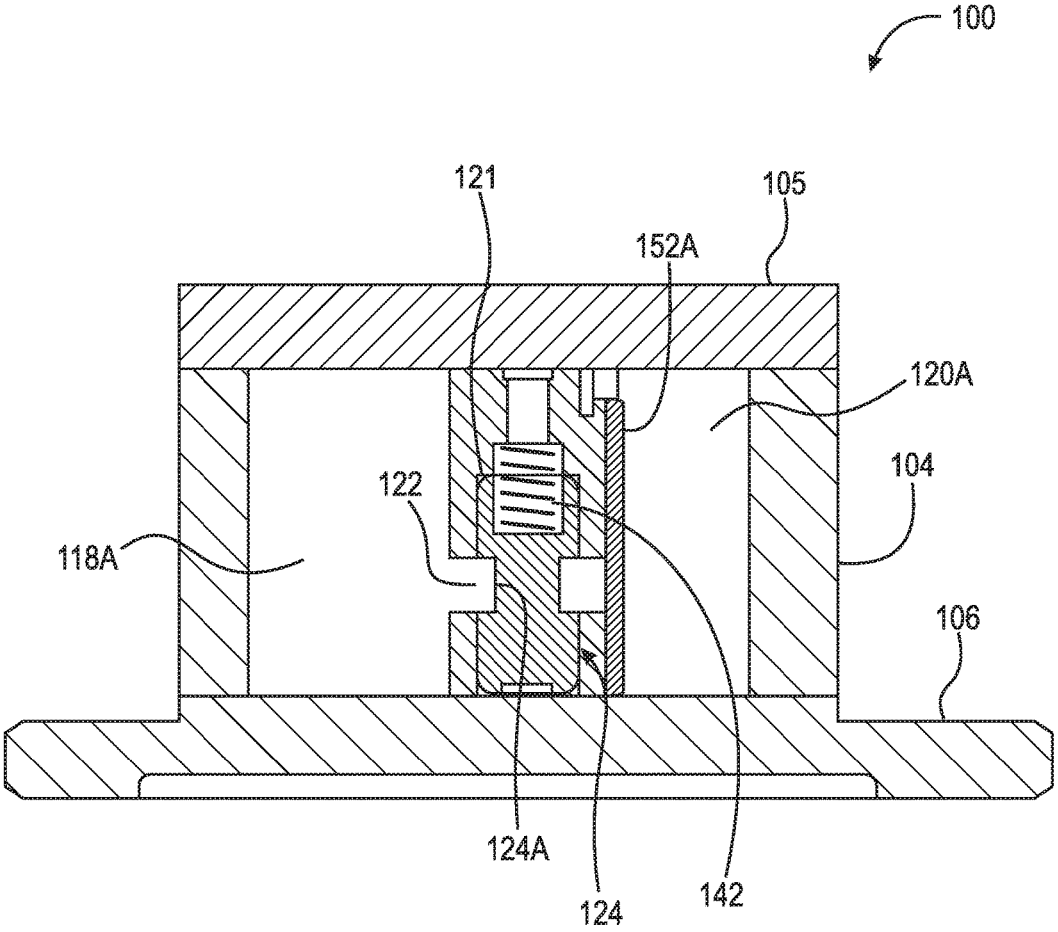
FIG. 14 is a cross-sectional views generally along line 14-14 in FIG. 5.

FIG. 14 is a cross-sectional views generally along line 14-14 in FIG. 5. The following should be viewed in light of FIGS. 2 through 14 and describes the transition from the mid-lock position to an operating position which enables controlled positioning of the rotor as needed for operation of a vehicle including phaser 100. Pressurized fluid is supplied to channel 127 and portions 127A. As shown in FIGS. 11 and 12, the pressurized fluid overcomes the force applied by springs 128 and displaces pins 124 in direction AD2 so that slots 124A and channels 122 are misaligned and pin 124 block fluid flow through the respective channels 122. As shown in FIG. 11, the pressurized fluid in channel 127 has displace pin 134 in direction AD2 so that pin 134 does not interfere with rotation of the rotor. Slot 134A and channel 132A are aligned to enable flow from chamber 118C to chamber 118A.

As shown in FIG. 12, the pressurized fluid in channel 127 has displaced pin 136 in direction AD2 so that pin 136 does not interfere with rotation of the rotor. Slot 136A and channel 132B are aligned to enable flow from chamber 120C to chamber 120A. As seen in FIG. 13, pin 137 is in contact with the front cover. Pressurized fluid is supplied to slot 139 through channels 141, 143, and 145 to urge pin 137 in direction AD1 against the force applied by spring 150. Therefore, as the rotor rotates and pin 137 rotates into alignment with slot 146, the pressurized fluid prevents pin 137 from displacing into slot 146. As seen in FIG. 14, pressurized fluid in portion 127A has displaced pins 124 in direction AD2 to misalign slots 124A and channels 122 to prevent fluid flow through channels 122.

Figure 15:
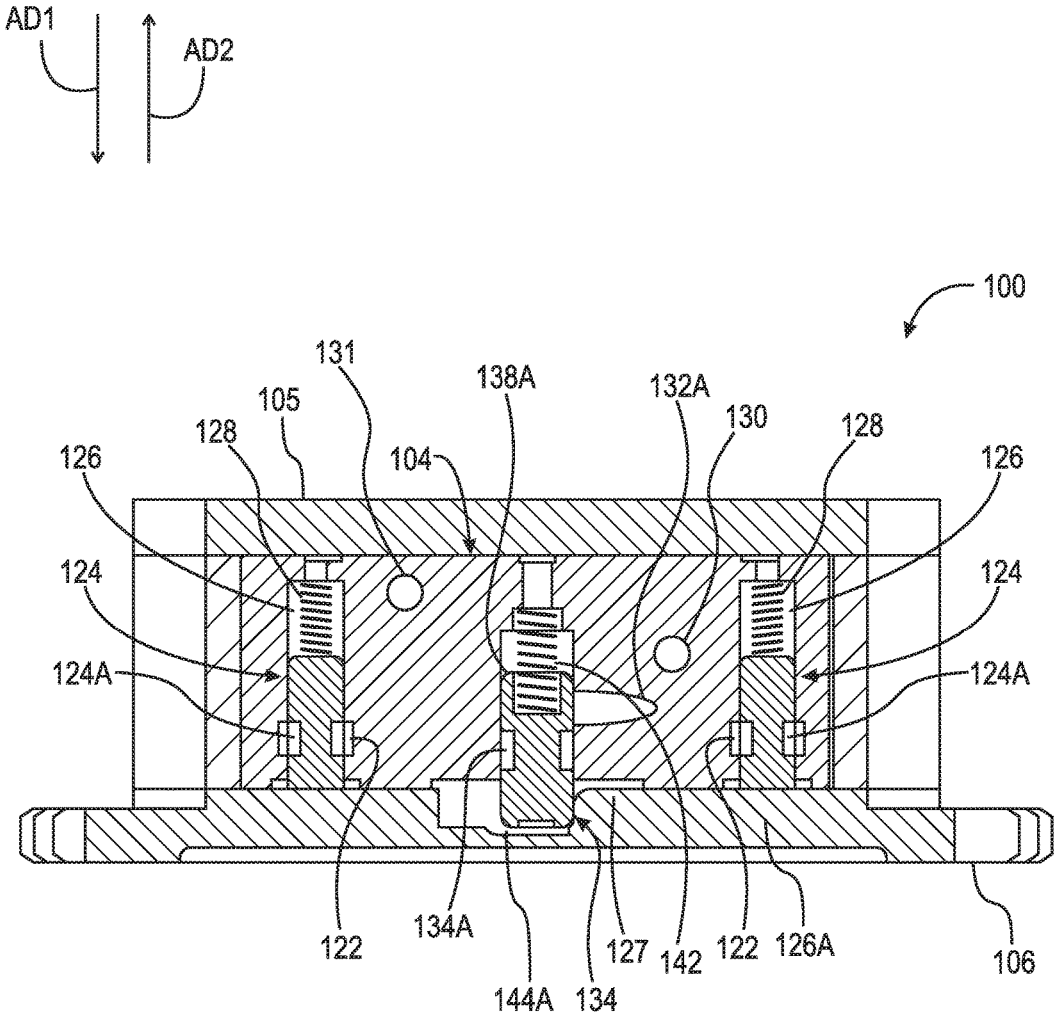
FIG. 15 is a cross-sectional views generally along line 15-15 in FIG. 6.

FIG. 15 is a cross-sectional views generally along line 15-15 in FIG. 6.

Figure 16:
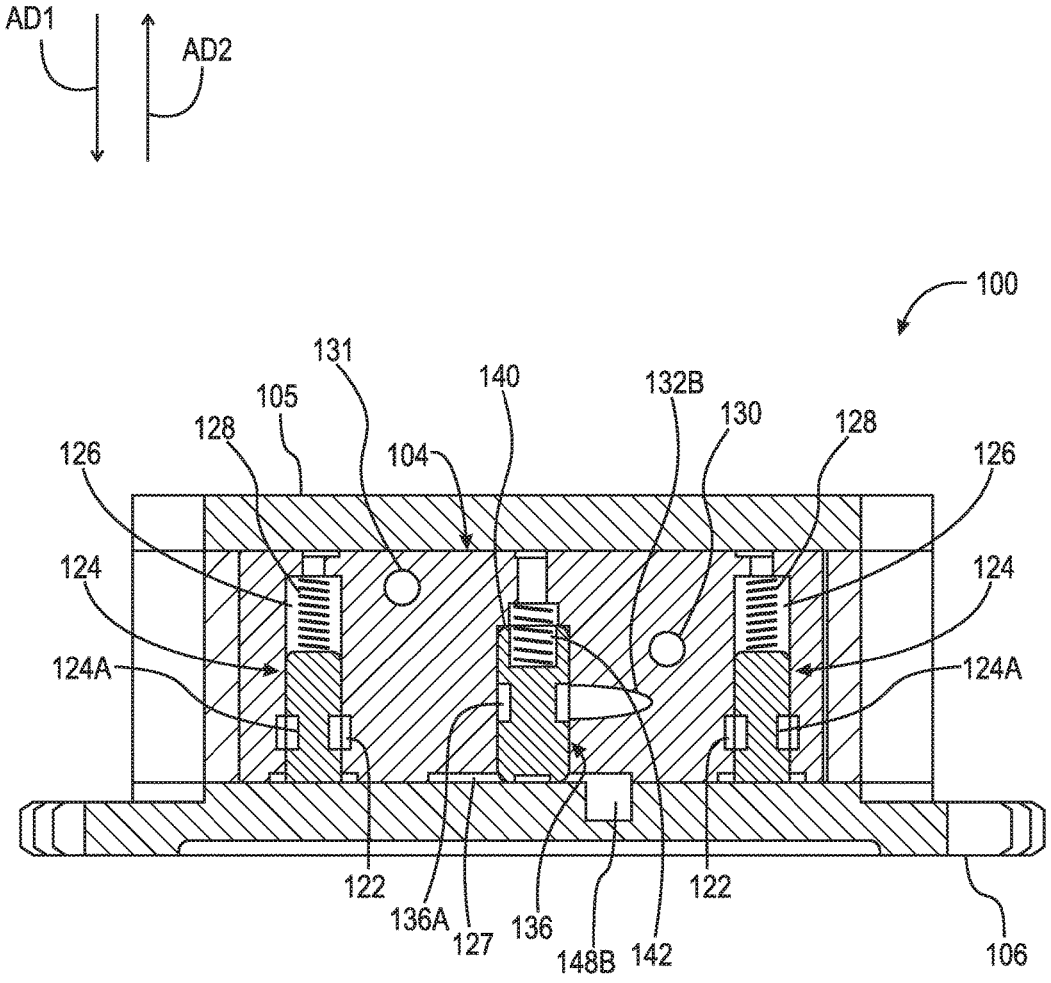
FIG. 16 is a cross-sectional views generally along line 16-16 in FIG. 6; and, FIG. 17 is a cross-sectional views generally along line 17-17 in FIG. 6.

FIG. 16 is a cross-sectional views generally along line 16-16 in FIG. 6.

Figure 17:
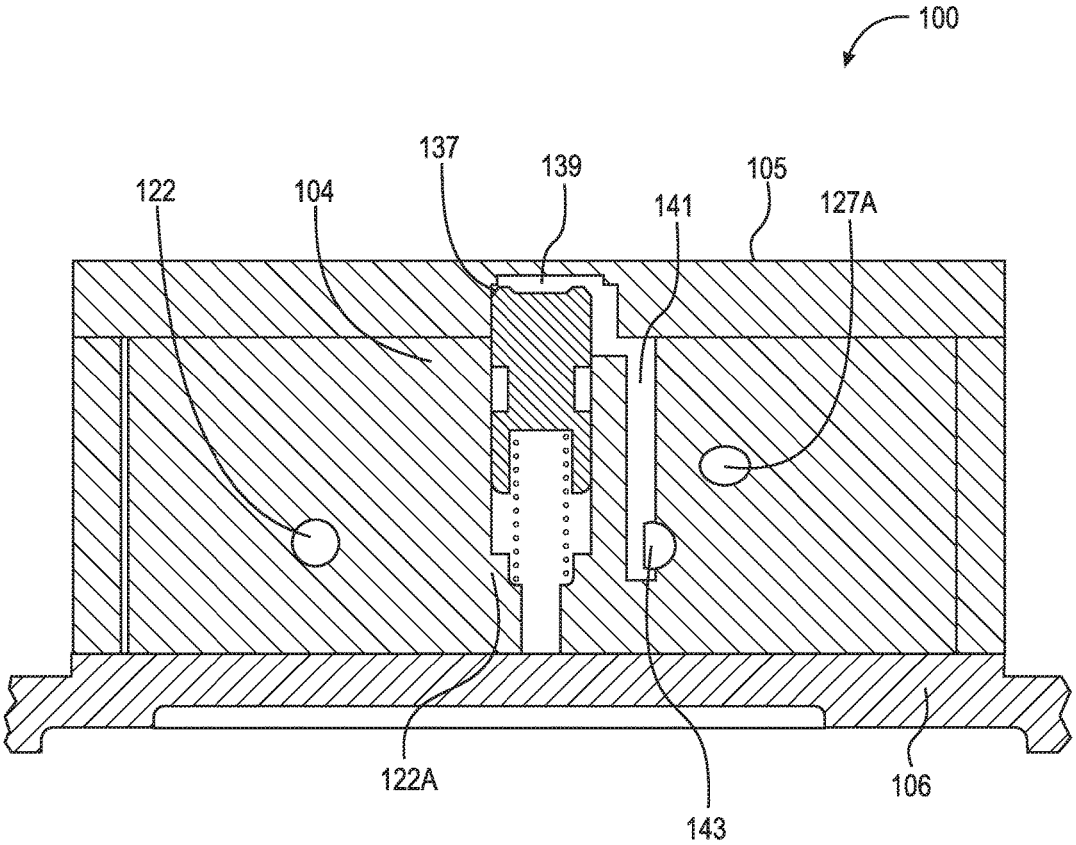

FIG. 17 is a cross-sectional views generally along line 17-17 in FIG. 6. The following should be viewed in light of FIGS. 2 through 17. FIGS. 15 through 17 show the configuration in the retard-lock position. In FIGS. 15 through 17, channel 127 and portions 127A are not pressurized. As seen in FIGS. 15 and 16, pins 124 are in contact with the rear cover. As seen in FIG. 15, pin 134 is displaced into slot 144A by pin 142. As seen in FIG. 16, pin 136 is in contact with the rear cover. As seen in FIG. 17, pin 137 is displaced into slot 146 by spring 150. Pin 132 blocks rotation in direction D2 and pin 137 blocks rotation in at least direction D1.

The following describes a method of operating a cam shaft phaser such as cam shaft phaser 100, including a stator 106 with radially inwardly extending stops 108, rotor 104 rotatable with respect to stator 106 and with body 110 with opening 112 through which axis of rotation AR for the cam shaft phaser passes and vanes 114 extending radially outward from the body, channels 122 with each channel 122 passing through a respective vane 114, pairs 116 of advance chambers 118 and retard chambers 120 at least partially formed by stops 108 and vanes 114, pin 137, and front cover 105 with slot 146, the method comprising: displacing pins 124, at least partially disposed channels 122 to connect, with channels 122, the advance chamber in each pair 116 with the retard chamber in each pair 116; flowing pressurized fluid: through channels 122 and between the advance chamber in each pair 116 and the retard chamber in each pair 116; rotating, with the pressurized fluid, the rotor in a first circumferential direction to a retard-lock position in which the rotor is rotated to a full extent possible in the first circumferential direction; and displacing pin 137 into slot 139 to rotationally fix the rotor in the retard-lock position.

Advantageously, cam shaft phaser 100 and a method using cam shaft phaser 100 addresses the problem noted above in which a rotor, such as rotor 104, comes to rest, or is in a position too far advanced or too far retarded. As noted above, controlling the various pins, channels and flow paths described above creates a ratcheting action that displaces the rotor into the mid-lock position. Further, it should be noted that the configuration and operation of cam shaft phaser 100 described above has no deleterious effect on normal operation of the phaser, for example, during normal operation of engine E, when the circumferential position of rotor 104 is modified according to the requirements of engine E, pins 124 block channels 122 and pins 134 and 136 are positioned so that channels 132A and 132B, respectively, are open.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A cam shaft phaser, comprising:

a stator including a plurality of radially inwardly extending stops;

a rotor rotatable with respect to the stator and including:

a body with an opening through which an axis of rotation for the cam shaft phaser passes; and, a plurality of vanes extending radially outward from the body;

a first plurality of channels; and, a plurality of pairs of advance chambers and retard chambers at least partially formed by the plurality of radially inwardly extending stops and the plurality of vanes, wherein:

for every pair of advance chambers and retard chambers included in the cam shaft phaser:

a respective vane, included in the plurality of vanes, separates a respective advance chamber and a respective retard chamber; and, a respective channel, included in the first plurality of channels, passes through the respective vane and connects the respective advance chamber and the respective retard chamber; and, the first plurality of channels is arranged to enable a fluid flow through the first plurality of channels to circumferentially displace the rotor.

2. The cam shaft phaser of claim 1, wherein:

the stator is arranged to be rotated in the first circumferential direction; and, for said every pair of advance chambers and retard chambers included in the cam shaft phaser:

the respective advance chamber is located past the respective retard chamber in the first circumferential direction; and, the respective retard chamber is located past the respective advance chamber in a second circumferential direction, opposite the first circumferential direction.

3. The cam shaft phaser of claim 1, further comprising:

a rear cover including a first slot and a second slot;

a front cover including a third slot; and, a first pin, a second pin, and a third pin, wherein:

in a mid-lock position, the first pin and the second pin are arranged to displace into the first slot and the second slot, respectively, to block rotation of the rotor;

in a retard-lock position, the third pin is arranged to displace into the third slot to block rotation of the rotor in at least one circumferential direction;

in the mid-lock position, the respective vane included in the plurality of vanes is mid-way between circumferentially adjacent radially inwardly extending stops included in the plurality of radially inwardly extending stops; and, in the retard-lock position, the respective vane included in the plurality of vanes is proximate a respective radially inwardly extending stop:

included in the plurality of radially inwardly extending stops; and, forming a portion of the respective retard chamber for said every pair of advance chambers and retard chambers included in the cam shaft phaser.

4. The cam shaft phaser of claim 1, further comprising:

a first plurality of pins, wherein:

a respective pin from the first plurality of pins is disposed in each respective channel included in the first plurality of channels; and, the first plurality of pins is displaceable to:

enable the fluid flow through the first plurality of channels; and, block the fluid flow through the first plurality of channels.

5. The camshaft assembly of claim 4, further comprising:

a second plurality of channels in the body of the rotor and a third plurality of channels in the body of the rotor; and, a first channel in the body of the rotor and a second channel in the body of the rotor, wherein:

with the exception of a first advance chamber included in the plurality of pairs of advance chambers and retard chambers, every advance chamber included in the plurality of pairs of advance chambers and retard chambers is connected to the opening with a respective channel from the second plurality of channels;

with the exception of a first retard chamber included in the plurality of pairs of advance chambers and retard chambers, every retard chamber included in the plurality of pairs of advance chambers and retard chambers is connected to the opening with a respective channel from the third plurality of channels;

the first channel connects the first advance chamber to a second advance chamber included in the plurality of pairs of advance chambers and retard chambers; and, the second channel connects the first retard chamber to a second retard chamber included in the plurality of pairs of advance chambers and retard chambers.

6. The cam shaft phaser of claim 5, wherein the rotor includes a first slot and a second slot, the cam shaft phaser further comprising:

a rear cover plate with a third slot and a fourth slot:

a first pin at least partially disposed in the first channel and in the first slot; and, a second pin at least partially disposed in the second channel and in the second slot, wherein to rotate the rotor from at least one circumferential position to a mid-lock position:

the first pin is arranged contact the rear cover plate such that the first channel is open between the first advance chamber and the second advance chamber; and, the second pin is arranged to displace into the fourth slot to block the second channel.

7. The cam shaft phaser of claim 6, wherein:

a first vane in the plurality of vanes separates the first retard chamber and a third advance chamber included in the plurality of pairs of advance chambers and retard chambers; and, a third channel, from the first plurality of channels, passing through the first vane, includes an opening at the first retard chamber, the cam shaft phaser further comprising:

a check valve at the opening for the third channel arranged to enable a fluid flow from the third advance chamber to the first retard through the third channel and to block a fluid flow from the first retard chamber to the third advance chamber through the third channel, wherein:

to rotate the rotor from the at least one circumferential position to the mid-lock position:

the third advance chamber is arranged to receive a pressurized fluid;

the first plurality of pins is arranged to displace to open the third channel;

the first retard chamber is arranged to receive the pressurized fluid through the third channel;

the rotor is arranged to rotate to the mid-lock position; and, the first pin and the second pin are arranged to engage the third slot and the fourth slot, respectively, to rotationally lock the rotor.

8. The cam shaft phaser of claim 7, wherein:

the cam shaft phaser is arranged to be connected to a cam shaft;

the cam phaser is arranged to receive, from the cam shaft:

a first rotational torque in the first circumferential direction; and, a second rotational torque in a second circumferential direction, opposite the first circumferential direction; and, to rotate the rotor from the at least one circumferential position to the mid-lock position:

the rotor is arranged to receive the first rotational torque;

the rotor is arranged to displace in the first circumferential direction;

a fluid is arranged to flow from the third advance chamber to the first retard chamber;

the rotor is arranged to receive the second rotational torque;

the check valve and the second pin are arranged to block a fluid flow out of the first retard chamber to block rotation of the rotor in the second circumferential direction.

9. The cam shaft phaser of claim 5, wherein the rotor includes a first slot and a second slot, the cam shaft phaser further comprising:

a rear cover plate with a third slot and a fourth slot:

a first pin at least partially disposed in the first channel and in the first slot; and, a second pin at least partially disposed in the second channel and in the second slot, wherein to rotate the rotor from at least one circumferential position to a mid-lock position, the second pin is arranged contact the rear cover plate such that the second channel is open between the first retard chamber and the second retard chamber, and the first pin is arranged to displace into the third slot to block the first channel.

10. The cam shaft phaser of claim 9, wherein:

a first vane in the plurality of vanes separates the first advance chamber and a third retard chamber included in the plurality of pairs of advance chambers and retard chambers; and, a third channel, from the first plurality of channels, for the first vane includes an opening at the first advance chamber, the cam shaft phaser further comprising:

a check valve at the opening for the third channel arranged to enable a fluid flow from the third retard chamber to the first advance chamber through the third channel and to block a fluid flow from the first advance chamber to the third retard chamber through the third channel, wherein:

to rotate the rotor from the at least one circumferential position to the mid-lock position:

the third retard chamber is arranged to receive a pressurized fluid;

the first plurality of pins is arranged to displace to open the third channel;

the first advance chamber is arranged to receive the pressurized fluid through the third channel;

the rotor is arranged to rotate to the mid-lock position; and, the first pin and the second pin are arranged to engage the third slot and the fourth slot, respectively, to rotationally lock the rotor.

11. The cam shaft phaser of claim 10, wherein:

the cam shaft phaser is arranged to be connected to a cam shaft;

the cam phaser is arranged to receive, from the cam shaft:

a first rotational torque in the first circumferential direction; and, a second rotational torque in a second circumferential direction, opposite the first circumferential direction; and, to rotate the rotor from the at least one circumferential position to the mid-lock position:

the rotor is arranged to receive the first rotational torque;

the rotor is arranged to displace in the first circumferential direction;

a fluid is arranged to flow from the third retard chamber to the first advance chamber;

the rotor is arranged to receive the second rotational torque;

the check valve and the first pin are arranged to block a fluid flow out of the first advance chamber to block rotation of the rotor in the second circumferential direction.

12. The cam shaft phaser of claim 5, wherein the body of the rotor includes a first slot, a second slot, and a third slot, the cam shaft phaser further comprising:

a rear cover plate with a fourth slot and a fifth slot;

a front cover with a sixth slot;

a first pin at least partially disposed in the first channel and in the first slot;

a second pin at least partially disposed in the second channel and in the second slot; and, a third pin, wherein:

to rotate the rotor from the at least one circumferential position to a retard-lock position:

the second pin is arranged to displace into the fourth slot to block a fluid flow through the second channel; and, the first pin is arranged to contact the rear cover plate such that a fluid flow through the first channel is enabled; and, in the retard-lock position, the third pin is arranged to displace into the sixth slot to block rotation of the rotor in at least one circumferential direction.

13. The cam shaft phaser of claim 12, wherein:

a first vane in the plurality of vanes separates the first retard chamber and a third advance chamber included in the plurality of pairs of advance chambers and retard chambers; and, a third channel, from the first plurality of channels, passing through the first vane, includes an opening at the first retard chamber, the cam shaft phaser further comprising:

a check valve at the opening for the third channel arranged to enable a fluid flow from the third advance chamber to the first retard chamber through the third channel and to block a fluid flow from the first retard chamber to the third advance chamber through the third channel, wherein:

to rotate the rotor from at least one circumferential position to the retard-lock position:

the third advance chamber is arranged to receive a pressurized fluid;

the first plurality of pins is arranged to displace to open the third channel;

the first retard chamber is arranged to receive the pressurized fluid through the third channel; and, the rotor is arranged to rotate to the retard-lock position.

14. The cam shaft phaser of claim 13, wherein:

the cam shaft phaser is arranged to be connected to a cam shaft;

the cam phaser is arranged to receive, from the cam shaft:

a first rotational torque in the first circumferential direction; and, a second rotational torque, in a second circumferential direction, opposite the first circumferential direction, respectively; and, to rotate the rotor from the at least one circumferential position to the retard-lock position:

the rotor is arranged to receive the first rotational torque;

the rotor is arranged to displace in the first circumferential direction;

a fluid is arranged to flow from the third advance chamber to the first retard chamber;

the rotor is arranged to receive the second rotational torque;

the check valve and the second pin are arranged to block a fluid flow out of the first retard chamber to block rotation of the rotor in the second circumferential direction.

15. A cam shaft phaser, comprising:

a stator including a plurality of radially inwardly extending stops;

a rotor rotatable with respect to the stator and including:

a body with an opening through which an axis of rotation for the cam shaft phaser passes;

a first channel in the body;

a second channel in the body; and, a plurality of vanes extending radially outward from the body;

a first plurality of channels;

a first plurality of pins; and, a plurality of pairs of advance chambers and retard chambers at least partially formed by the plurality of radially inwardly extending stops and the plurality of vanes, the plurality of pairs of advance and retard chambers including:

a first advance chamber and a second advance chamber; and, a first retard chamber and a second retard chamber, wherein:

the first channel connects the first advance chamber and the second advance chamber;

the second channel connects the first retard chamber and the second retard chamber;

each vane, included in the plurality of vanes, includes:

a respective channel included in the first plurality of channels; and, a respective pin from the first plurality of pins, the respective pin partially disposed in the respective channel from the first plurality of channels;

the first plurality of pins is displaceable to open the first plurality of channels to displace the rotor from at least one first circumferential position to a retard-lock position;

for every pair of advance chambers and retard chambers included in the cam shaft phaser:

a respective vane, included in the plurality of vanes, separates a respective advance chamber and a respective retard chamber; and the respective channel, included in the first plurality of channels, connects the respective advance chamber and the respective retard chamber;

the first plurality of channels is arranged to be opened to enable a fluid flow through the first plurality of channels to displace the rotor from the at least one circumferential position to the retard-lock position; and, in the retard-lock position, the rotor is rotated in a direction, from the advance chamber to the retard chamber in a first pair of advance and retard chambers.

16. The camshaft assembly of claim 15, further comprising:

a second plurality of channels and a third plurality of channels in the body of the rotor, wherein:

with the exception of the first advance chamber, every advance chamber included in the plurality of pairs of advance chambers and retard chambers is connected to the opening with a respective channel from the second plurality of channels; and, with the exception of the first retard chamber, every retard chamber included in the plurality of pairs of advance chambers and retard chambers is connected to the opening with a respective channel from the third plurality of channels.

17. The cam shaft phaser of claim 16, wherein the body of the rotor includes a first slot, a second slot, and a third slot, the cam shaft phaser further comprising:

a rear cover plate with a fourth slot and a fifth slot;

a front cover with a sixth slot;

a first pin at least partially disposed in the first channel and in the first slot;

a second pin at least partially disposed in the second channel and in the second slot; and, a third pin, wherein:

to rotate the rotor from the at least one circumferential position to the retard-lock position:

the second pin is arranged to displace into the fourth slot to block fluid flow through the second channel; and, the first pin is arranged to contact the rear cover plate such that a fluid flow through the first channel is enabled; and, in the retard-lock position, the third pin is arranged to displace into the sixth slot to block rotation of the rotor in at least one circumferential direction.

18. The cam shaft phaser of claim 17, wherein:

a first vane in the plurality of vanes separates the first retard chamber and a third advance chamber included in the plurality of pairs of advance chambers and retard chambers; and, a third channel, from the first plurality of channels, passing through the first vane includes an opening at the first retard chamber, the cam shaft phaser further comprising:

a check valve at the opening for the third channel arranged to:

enable a fluid flow from the third advance chamber to the first retard chamber through the third channel; and, to block a fluid flow from the first retard chamber to the third advance chamber through the third channel, wherein:

to rotate the rotor from the at least one circumferential position to the retard-lock position:

the third advance chamber is arranged to receive a pressurized fluid;

the first plurality of pins is arranged to displace to open the third channel;

the first retard chamber is arranged to receive the pressurized fluid through the third channel; and, the rotor is arranged to rotate to the retard-lock position.

19. The cam shaft phaser of claim 18, wherein:

the cam shaft phaser is arranged to be connected to a cam shaft;

the cam phaser is arranged to receive, from the cam shaft:

a first rotational torque in the first circumferential direction; and, a second rotational torque in a second circumferential direction, opposite the first circumferential direction; and, to rotate the rotor from the at least one circumferential position to the retard-lock position:

the rotor is arranged to receive the first rotational torque;

the rotor is arranged to displace in the first circumferential direction;

a fluid is arranged to flow from the third advance chamber to the first retard chamber;

the rotor is arranged to receive the second rotational torque;

the check valve and the first pin are arranged to block flow of the fluid out of the first retard chamber to block rotation of the rotor in the second circumferential direction.

20. A method of operating a cam shaft phaser including:

a stator with a plurality of radially inwardly extending stops;

a rotor rotatable with respect to the stator and with a body with a first channel, a second channel and an opening through which an axis of rotation for the cam shaft phaser passes, and a plurality vanes extending radially outward from the body; a first plurality of channels with each channel in the first plurality of channels passing through a respective vane included in the plurality of vanes; a plurality of pairs of advance chambers and retard chambers, at least partially formed by the plurality of radially inwardly extending stops and the plurality of vanes, and including a first advance chamber and a second advance chamber connected by the first channel, and a first retard chamber and a second retard chamber connected by the second channel; a first pin; and a front cover with a first slot, the method comprising:

displacing a first plurality of pins at least partially disposed in the first plurality of channels;

blocking the first channel with the first pin;

flowing a pressurized fluid:

through the first plurality of channels; and, between an advance chamber and a retard chamber in each pair of advance chambers and retard chambers included in the cam shaft phaser;

rotating, with the pressurized fluid, the rotor in a first circumferential direction to a retard-lock position; and, displacing the first pin into the first slot to rotationally fix the rotor in the retard-lock position.

* * * * *